US006070267A

United States Patent [19]

McKewin

[11] Patent Number: 6,070,267

[45] Date of Patent: Jun. 6, 2000

[54] KNEE PAD HOLDER

[76] Inventor: Kevin J. McKewin, 7238 N. OSceola, Chicago, Ill. 60631

[21] Appl. No.: 09/439,269

[22] Filed: Nov. 12, 1999

[51] Int. Cl.[7] ..... A41D 13/06

[52] U.S. Cl. ..... 2/23; 2/24; 2/227

[58] Field of Search ..... 2/23–24, 22, 16, 2/59, 62, 227, 911; 128/881, 882; 602/26, 62, 63

[56] References Cited

U.S. PATENT DOCUMENTS

| | | | |
|---|---|---|---|
| 1,225,799 | 5/1917 | Goldsmith | 2/23 |
| 1,636,553 | 7/1927 | Cruden | 2/23 |
| 1,669,085 | 5/1928 | Guyon | 2/23 |
| 4,561,123 | 12/1985 | Hull | 2/23 |
| 5,255,391 | 10/1993 | Levine | 2/24 |
| 5,537,689 | 7/1996 | Dancyger | 2/24 |
| 5,594,954 | 1/1997 | Huang | 2/24 |
| 5,915,529 | 6/1999 | Popowski | 2/24 |

*Primary Examiner*—John J. Calvert
*Assistant Examiner*—Tejash Patel
*Attorney, Agent, or Firm*—Paul H. Gallagher

[57] ABSTRACT

Loops secured the trousers sleeves of the wearer, on the exterior thereof, through which the knee pad straps are passed for holding the knee pad from sliding down the leg of the wearer.

5 Claims, 1 Drawing Sheet

KNEE PAD HOLDER

FIELD OF THE INVENTION

The invention relates to knee pads such as those used by construction workers, and others. Knee pads have been used for a long time, but a serious objection always existed in holding the knee pad at the desired position on the leg. In the actions of the worker in the various fields, the leg is flexed very often, and regardless how securely the knee pad is applied to the knee, in many cases the knee pad almost always moves or migrates down the leg. A worker assumes a kneeling position, and a standing and stretched position, and in these opposite positions, it is difficult, if not impossible, to maintain the knee pad in proper position.

The various devices heretofore used for maintaining the knee pad in proper position have not been completely successful. They often have been very complex and difficult to apply to the knee; for example, devices have been designed for securing the knee pad to the underclothing of the wearer, which resulted in difficulties in applying it, and objectionable time was required for applying

SUMMARY OF THE INVENTION

The device of the present invention is a simple means to utilize with conventional knee pads.

A principal object is the provision of an extremely simple means for securing a knee pad of known kind to the clothing of the wearer, and more particularly applied and secured to the exterior of the clothing. More specifically, an object of the invention is to provide simple loops or keepers of the kind usually used for holding a belt for trousers, to be utilized with a securing strap of the knee pad for holding the knee pad in place.

Another and more specific object is to provide such loops on the exterior of the trousers. The loops are of extremely small size, and if the wearer wishes to wear the clothing without the knee pads, the knee pad can be simply and quickly detached, and the loops are so small and so located that they are inconspicuous, and even nearly unnoticeable, and do not interfere with the actions of the wearer.

As Another advantage of the device of the present invention is that it is very inexpensive and can be applied to the clothing, as an original piece of the clothing in a very simple and inexpensive manner.

DETAILED DESCRIPTION OF THE DRAWINGS

The wearer's leg is indicated at 10 including the thigh 12 and lower leg or calf 14, and the wearer's clothing is indicated at 16 constituted by a leg sleeve of a pair of trousers or coveralls. The portion of the leg shown in FIG. 1 is simply that sufficient to include the knee of the wearer, and a small portion above and below, which the knee pad covers.

Figure 1:
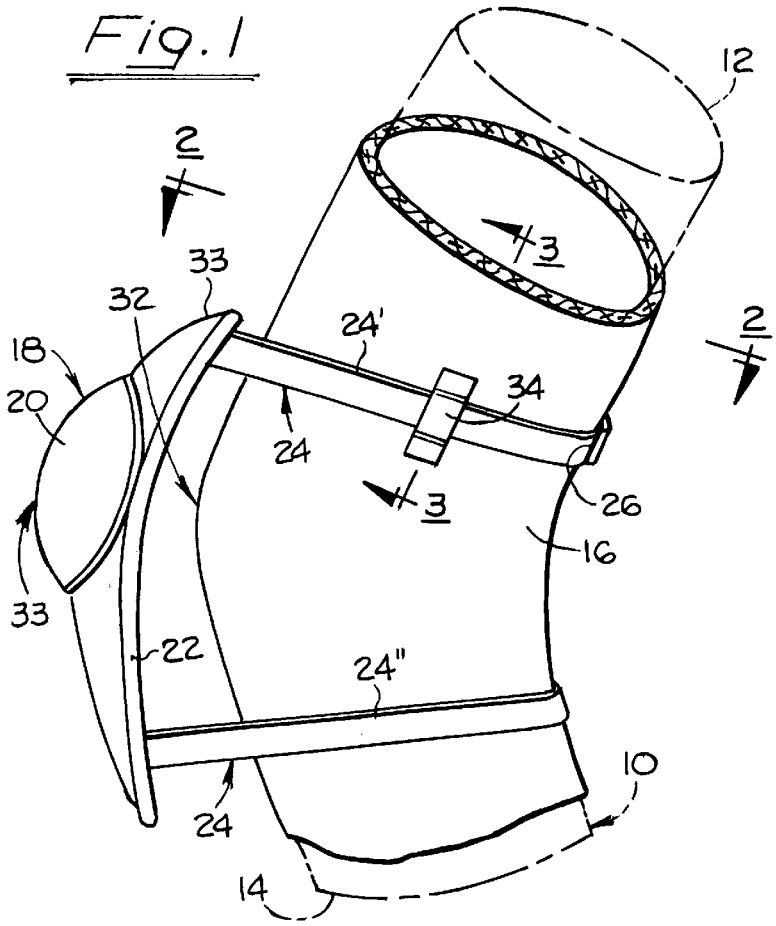
FIG. 1 is a side view of a knee and a knee pad in position of fitting it to the knee, and including the holder of the present invention.

FIG. 1 shows a conventional knee pad 18 which includes a resilient pad element 20 and a backing member 22 of relatively thin dimensions to which the pad element 20 is secured. This portion of the construction of the knee pad is conventional, and need not be described in detail.

The knee pad 18 includes conventional straps 24, which in this case are two in number, spaced vertically and arranged for encircling the wearers leg. The straps may be of any desired detail construction; the upper strap 24' is made up of two pieces one end of each having a securing element of VELCRO type at 26 which are detachably secured together. The lower strap 24" may be similar, but is of a single piece and has one end embodied in the structure of the pad at 28 and the outer end has a securing element 30 of VELCRO type cooperably with a counterpart element on the pad.

In such a conventional knee pad, the straps 24, while being operable for holding the knee pad on the leg, have not been effective for holding it against downward movement. As noted above, in the movements of the wearer, getting into and out of kneeling position, and also in standing and stretching position, the leg flexes in various ways, not only angularly, but the muscles in kneeling position and in standing position respectively, assume different individual contours, such as bulging and thinning as a result of which the knee pad could not be held or maintained in the desired position but would drift or move downwardly of the leg. The difficulty in this condition is that the leg, at the knee and above the knee together, thin down in dimensions, in downward direction, and all tendencies work toward moving the knee pad downwardly, and there is a constant condition of annoyance in maintaining the knee pad in proper position.

The knee pad 18 is curved complementary to the knee. The backing member 22 has an upper portion 31 extending above the cushion, to which the upper strap 24' is secured. As viewed in FIG. 1, the extreme point of the knee is indicated at 32, and a corresponding high point in the knee pad is indicated at 33. Ideally the knee pad is to be held with the high point 33 in register with the high point 32.

Figure 3:
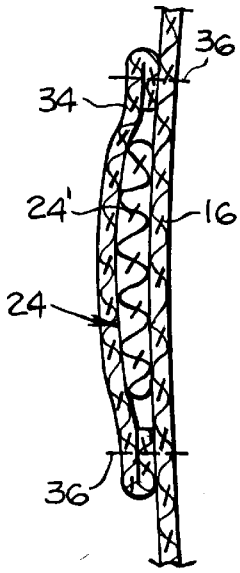
FIG. 3 is a sectional view, taken at line 3—3 of FIG. 1.
Figure 2:
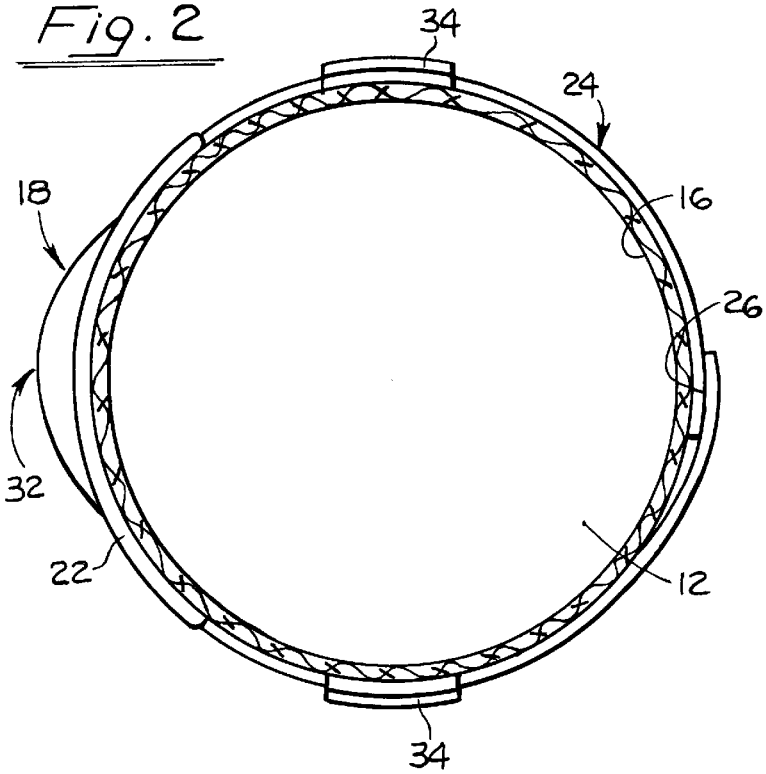
FIG. 2 is a view oriented according to line 2—2 of FIG. 1.

In the device of the present invention, loops or keepers 34 are secured to the trousers leg 16. These loops are similar to the loop or keeper ordinarily used for holding a belt at the waist, and may be made of the same material as is the leg sleeve 16, e.g. denim. These loops are provided for use only with the upper strap 24', it not being necessary to provide for use with the lower strap. The specific construction the loop itself, may be such as includes a narrow strip stitched to the trousers leg as indicated at 36 (FIG. 3). These loops may be two or three in number, for example, spaced around the leg, the particular number not being critical.

For best results, the loops 34 are place at a predetermined height above the high point 32 of the knee, so as to result in a spacing of approximately 3" between the lower edge of the top strap to the high point of the knee. Although workers would of course be of various heights, the differences in dimensions involved would be very minor, that is, even as between a tall worker and a short worker the difference in spacing between the upper strap 24 and the high point 30, may be on the order of ¼". The dimensions herein referred to are the preferred dimensions, but only examples, and the construction is not limited to the precise dimensions mentioned.

It will be observed from the above, that the device of the present invention is extremely simple both in its design and construction, and in the steps of incorporating it in the wearer's clothing. Each loop is simply a small piece of cloth material, and it is applied to the trousers leg in a very simple step, substantially identical with that of applying the loops for the belt of the trousers. In applying the knee pad to the knee, the user would simple thread the loose end of the top strap through the the loops, and secure them together as referred to above. The only difference in applying the knee pad in the present case as compared with applying it heretofore, is the threading of the straps through the loops.

When the worker wishes to be active without the knee pad in place, it is simply removed, and the loops 34 do not cause any inconvenience or annoyance. They are small and do not hinder the wearer. Additionally, they are inconspicuous.

Figure 4:
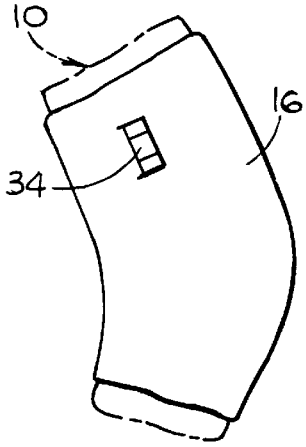
FIG. 4 is a small-scale view of a portion of the clothing bearing the device of the invention, without the knee pad in position thereon.

FIG. 4 shows the loop applied to the trousers, without the knee pad, to show how small it is, and that it would not interfere with any movements of the wearer. Also this shows how inconspicuous it is.

The invention is not limited to a particular form of knee pad, but resides in the loop which can be used with any of various forms of knee pads.

What is claimed is:

1. Knee pad holding means for clothing for use on a trousers sleeve, wherein the knee pad includes a central cushion element and a backing member, the knee pad being adapted for application to the trousers sleeve at a position wherein the cushion element is over the knee, the knee pad having side edges, the knee pad including straps secured to the side edges of the knee pad at vertically spaced locations, each strap having a first end secured to the backing member and a free end with detachable securing means thereon, the straps being adapted to be fitted around the leg of the wearer and the free ends of the respective straps secured to the backing member, the knee pad securing means including, at least one loop, adapted to secure to the trousers sleeve for receiving at least one of the straps for holding the knee pad on the trousers sleeve against sliding downwardly.

2. Knee pad securing means according to claim 1 wherein, the knee pad has an intermediate high point for accommodating the high point of the knee of the nearer, the top strap has a lower edge positioned in the neighborhood of 3 inches above the high point of the knee pad, and the loops are so positioned at such level on the trousers sleeve as to position the high point on the knee pad at approximately in register with the high point of the knee of the wearer.

3. Knee pad securing means according to claim 2 wherein, the loops are positioned on the exterior of the trousers sleeve.

4. Knee pad securing means according to claim 3 wherein, the knee pad includes a plurality of securing straps, spaced vertically, and the securing loops are all in a common level and positioned for accommodating only a single securing strap.

5. Knee pad securing means according to claim 4 wherein, the loops are positioned for accommodating only the top securing strap.

* * * * *